United States Patent [19]

Fredd

[11] 4,266,614

[45] May 12, 1981

[54] VALVE

[75] Inventor: John V. Fredd, Dallas, Tex.

[73] Assignee: Otis Engineering Corporation, Dallas, Tex.

[21] Appl. No.: 56,886

[22] Filed: Jul. 12, 1979

[51] Int. Cl.[3] ..... E21B 34/14

[52] U.S. Cl. ..... 166/332; 166/154; 251/149.1

[58] Field of Search ..... 166/332, 318, 154; 251/149.1

[56] References Cited

U.S. PATENT DOCUMENTS

| | | | |
|---|---|---|---|
| 3,263,752 | 8/1966 | Conrad | 166/154 |
| 3,306,365 | 2/1967 | Kammerrer, Jr. | 166/318 |
| 3,527,297 | 9/1970 | Todd | 166/154 |
| 3,768,556 | 10/1973 | Baker | 166/318 |

*Primary Examiner*—William F. Pate, III

*Attorney, Agent, or Firm*—Vinson & Elkins

[57] ABSTRACT

A valve which may be made up as a part of a tubing string, preferably by removably landing the valve in a landing nipple. The valve is of the sleeve type and the gap through the valve member is held to very close spacing when the valve member gap passes over the seals in the body and is then permitted to expand when the valve member is in open position. The valve is disclosed as a part of a testing system employing a packer, a foot valve, a seal unit and a landing nipple in which the valve is supported.

15 Claims, 9 Drawing Figures

Fig. 6
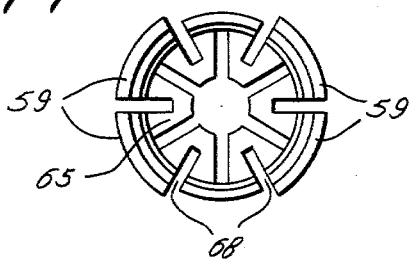
Fig. 8
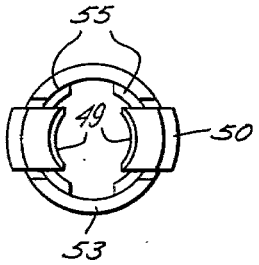
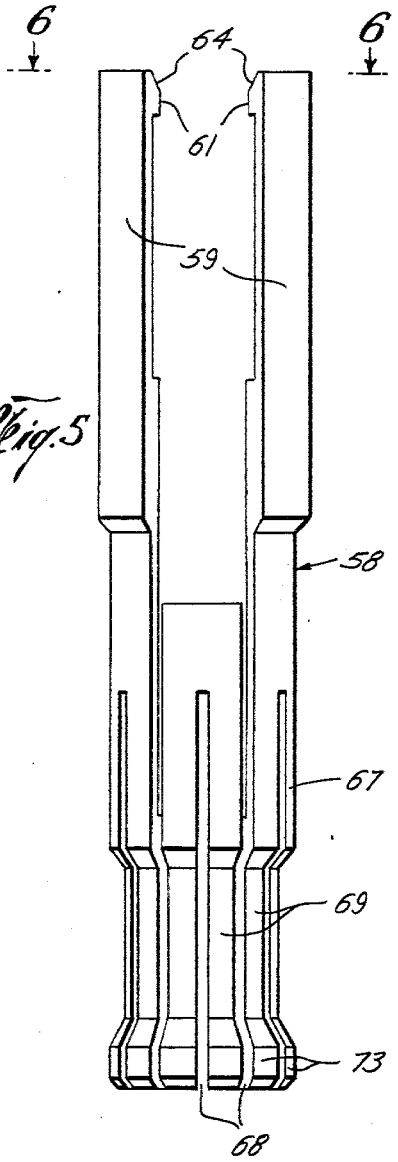
Fig. 5
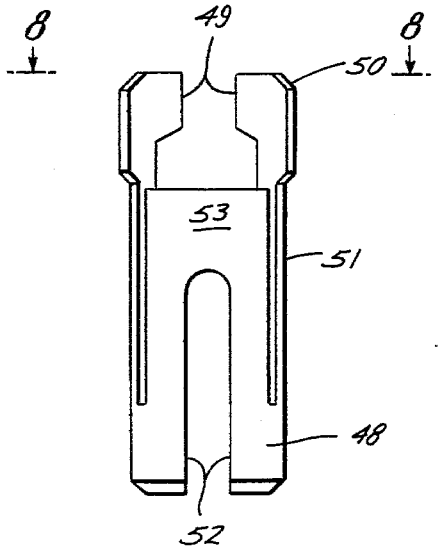
Fig. 7

VALVE

This invention relates to valves. In one form it relates to valves which may form a part of a tubing string. Preferably, the valve is supported in removable fashion in a landing nipple so that it may be removed after testing procedures are completed. The valve is designed to receive a pressure conducting prong which may be connected to the surface through a suitable electric line to transmit signals corresponding to the pressure of the fluid at the valve and thus the valve may be referred to in this and related applications as a transducer fitting.

While this invention was developed for use in testing of petroleum wells it will find usefulness in any system in which a sleeve valve member is used in conjunction with seals such as O-rings in the presence of high pressures. In these instances there is a problem of damage to the O-ring as the valve member passes over the O-ring and the system goes from a substantial differential in pressure across the O-ring to a greatly reduced differential and vice versa. The porting through which fluid flows in the valve member of a sleeve valve preferably is so small that the O-ring cannot be extruded into the porting and thus the O-ring is protected against damage. On the other hand, the porting preferably is large enough to permit acceptable flow of fluid through the porting. These two objectives are of course inconsistent with each other.

It is a principal object of this invention to provide a sleeve valve in which the porting through the valve member is extremely small as the valve member moves between opened and closed positions to protect the seals and when the valve is open the porting opens up to permit the desired volume of flow through the valve.

Another object is to provide a valve as in the preceding object in combination with a prong which may be utilized to open and close the valve in which dogs within the valve are moved between a prong engaging and prong releasing position in response to movement of the valve between open and closed positions.

It is a still further object to provide such a valve and prong with a seal between the valve member and the prong and a flow passage in the prong so that fluid passing through the sleeve valve may be conducted to a pressure recording or transmitting device.

It is another object to provide such a valve with a prong and automatic latching means between the sleeve valve and prong such that when the prong is withdrawn the sleeve valve automatically closes and traps in the sleeve valve and in the landing nipple thereabove a sample of formation fluid.

Another object is to provide a sleeve valve with a two-piece sleeve valve member in which the two members are in abutting relationship and are automatically held close to each other while the juncture between the two parts is passing over seals in the valve and which permits the two parts to move apart from each other after the seals have been cleared to reduce the tendency of seals to be damaged at the juncture between the two parts of the valve member as they are moving across the seals and to permit the two parts to open up under pressure of fluid being controlled to give an adequate size passageway for the fluid to flow through the valve.

Another object is to provide a valve as in the preceding object in which the valve may be moved between open and closed position by moving a prong axially in the valve to move the valve member between open and closed positions and in which when the valve member is moved to closed position the prong is released to permit it to be withdrawn from the valve; the prong being latched to the valve member while the valve member is in open position so that withdrawal of the prong automatically moves the valve member from open to closed position and then releases the prong.

Other objects, features and advantages of this invention will be apparent from the drawings, the specification and the claims.

In the drawings wherein an illustrative embodiment of this invention is shown and wherein like reference numerals are used to indicate like parts:

FIG. 5 is an elevational view of the arm utilized to control the gap in the two-piece valve member;

FIG. 6 is an end view of FIG. 5 taken along the lines 6—6 of FIG. 5;

FIG. 7 is an elevational view of the latch collet for latching a prong to the valve member;

FIG. 8 is an end view of the collet of FIG. 7 taken along lines 8—8 of FIG. 7.

Figure 1:
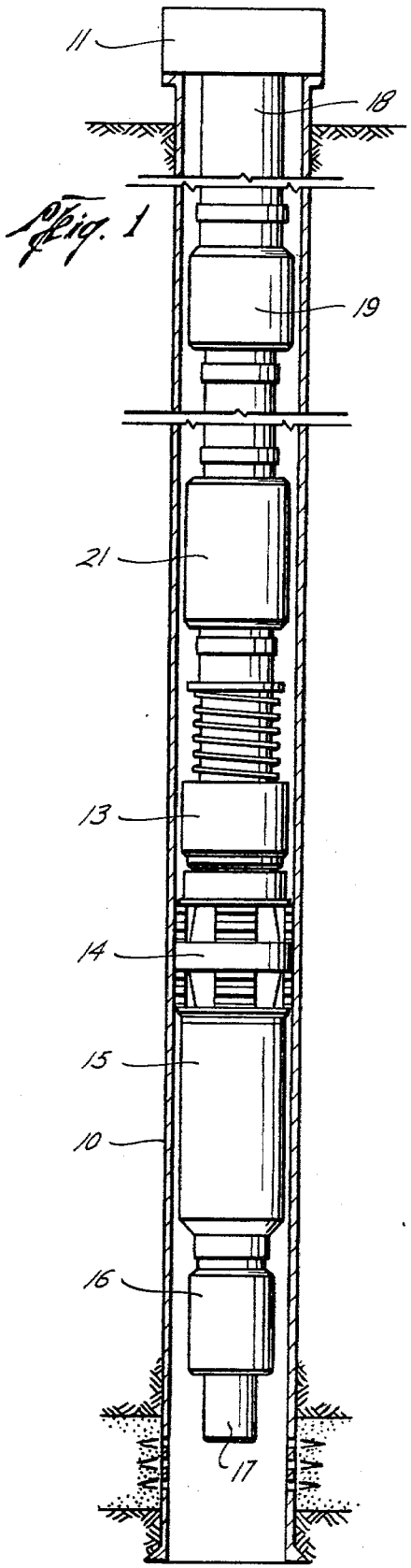
FIG. 1 is a schematic illustration of a well test installation employing the valve of this invention.
Figure 4:
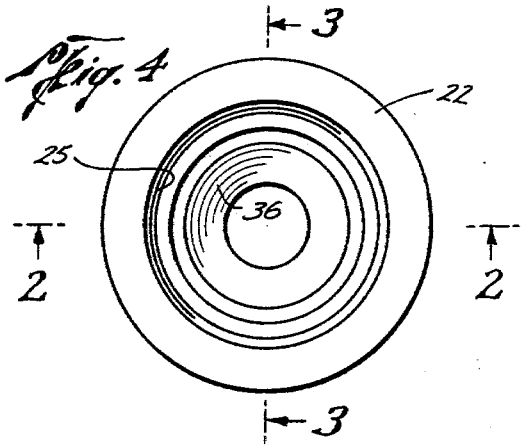
FIG. 4 is an end view of the valve of this invention.

Referring first to FIG. 1 there is shown a well having a casing 10 and standard surface equipment 11 at the top of the well. The casing and well are shown to be preforated at 12 into the formation to be tested.

Within the well there is an assembly made up of a packer 14, foot valve 15, landing nipple 16, and valve or transducer fitting 17, which are preferably run into the well and landed in place in a preliminary operation as by conventional wireline techniques.

The test or production tubing 18 is shown to have a circulating valve 19, a cushion valve 21 and a seal unit 13 with the tailpipe of the seal unit in sealing engagement with the packer 14. During running of the tubing 18, the cushion valve may be utilized to support a column of fluid in the tubing which is released by opening of the cushion valve when the string engages the packer 14.

The packer 14 packs off the producing formation and the foot sleeve valve 15 controls the flow through the foot sleeve and into the tubing. The landing nipple and transducer fitting provide for landing a transducer, such as a pressure sensing device, within the fitting to sense the pressure in the casing and below the packer. With this assembly, static pressure in the formation below the packer as well as build-up pressure can be recorded or transmitted to the surface through a suitable electric line and flow can be provided through the foot sleeve valve to test the flow characteristics of the well.

During testing operations, the circulating valve is normally closed. Conditions may arise, however, when it is desirable or imperative to provide for circulation between the casing-tubing annulus and the tubing. The circulating valve 19 may be quickly and readily opened to provide for such circulation.

The valve of this invention may be used in any desired setting. It was developed, however, to form a part of the testing system shown and its construction and operation will be explained in this setting. The invention, however, is not restricted to the system shown and the valve may be positioned other than in the relationship shown and may be used in any desired setting in which its functions would be beneficial.

The transducer fitting or valve 17 is suspended from the landing nipple 16 which in turn is suspended from packer 14. Suitable landing nipples and locking mandrels are shown at page 5324 of the *Composite Catalog of Oilfield Equipment and Services,* 33rd Revision for 1978–1979. The valve of this invention may be attached to a locking mandrel and positioned in the nipple during running of the packer. In the alternative, the bore through the landing nipple may be left open and after the tubing string has been landed the mandrel and transducer fitting may be run into and landed in the landing nipple.

In either event with the valve or transducer fitting 17 in place a suitable prong may be run into the well to shift the valve 17 between open and closed position. Also, if desired, the running tool for the locking mandrel may have an extension thereon carrying a suitable prong in the transducer fitting 17 to hold the valve in the desired open or closed position. In the same manner, when removing the locking mandrel and transducer fitting the rulling tool for the locking mandrel may have a suitable prong thereon to hold the transducer fitting in the desired open or closed position during pulling of the locking mandrel and transducer fitting.

The transducer fitting or valve 17 has an upper body section 22 and a lower body section 23 suitably threaded together by the thread and seal system indicated generally at 24. The upper end of the body is provided with threads 25 for coupling the transducer fitting to a locking mandrel so that the mandrel and transducer fitting may be supported in the landing nipple 16.

At the lower end of the valve, threads 26 are provided and it is preferred that a length of tubing be secured by the threads 26 to the lower end of the valve and that the bottom of the tubing be closed so that flow into the tubing can only enter through the transducer fitting. This length of tubing provides a basket or sump into which any particulate matter which may find its way into the tubing may fall through the transducer fitting and be collected. It is noted that the locking mandrel on which the transducer fitting is run is provided with suitable packing to seal between the locking mandrel and the landing nipple 16 and thus with the bottom of the valve 17 closed flow is restricted to that permitted by the valve 17 or by the foot valve 15.

The body of the valve includes a seal carrying fitting 27 having a flow port 28 extending radially therethrough and terminating in a distributing groove 29. The body 22 has a port 31 therein. The seal carrier 27 is positioned such that the port 28 and port 31 are aligned and the seal carrier 27 is then welded in place with the weld forming a seal between the body 22 and the seal carrier 27.

The seal carrier 27 is provided on opposite sides of the port 28 with grooves 32 and 33. Suitable seals such as O-rings 34 and 35 are positioned in these grooves, extend circumferentially about the fitting 27 and straddle the flow port 28. The seals are of equal diameter so that pressure from port 28 is balanced and only friction need be overcome in shifting the valve member.

A suitable valve member is provided by funnel 36 and liner 37. Preferably the valve member is tubular in form. The juncture or abutment between the funnel 36 and liner 37 provides for flow from the exterior to the interior bore of the valve member when the valve is in open position. In accordance with this invention this juncture between the funnel and liner is held to very close tolerance as the juncture moves over the O-ring 34. Preferably this tolerance is on the order of 1/1000". After the juncture has passed over the O-ring 34 then the funnel and liner are permitted to move apart from each other and provide several thousandths of an inch of clearance to permit fluid to flow readily through the valve.

Figure 2:
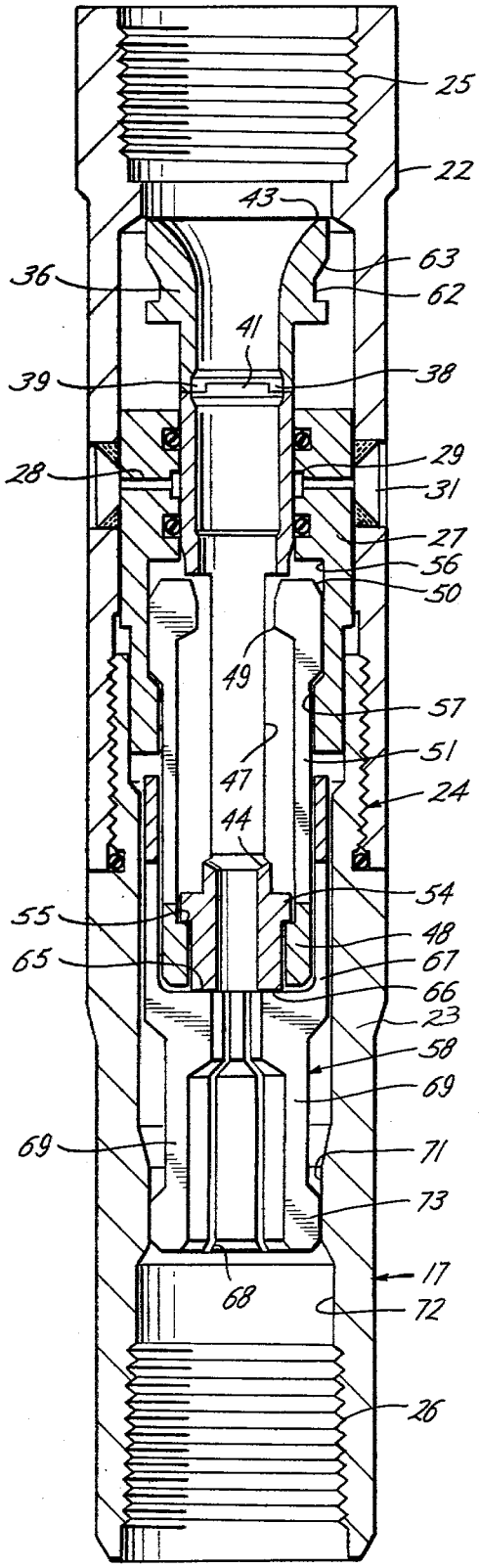
FIG. 2 is a cross-sectional view through the valve of this invention taken along the lines 2—2 of FIG. 4.
Figure 3:
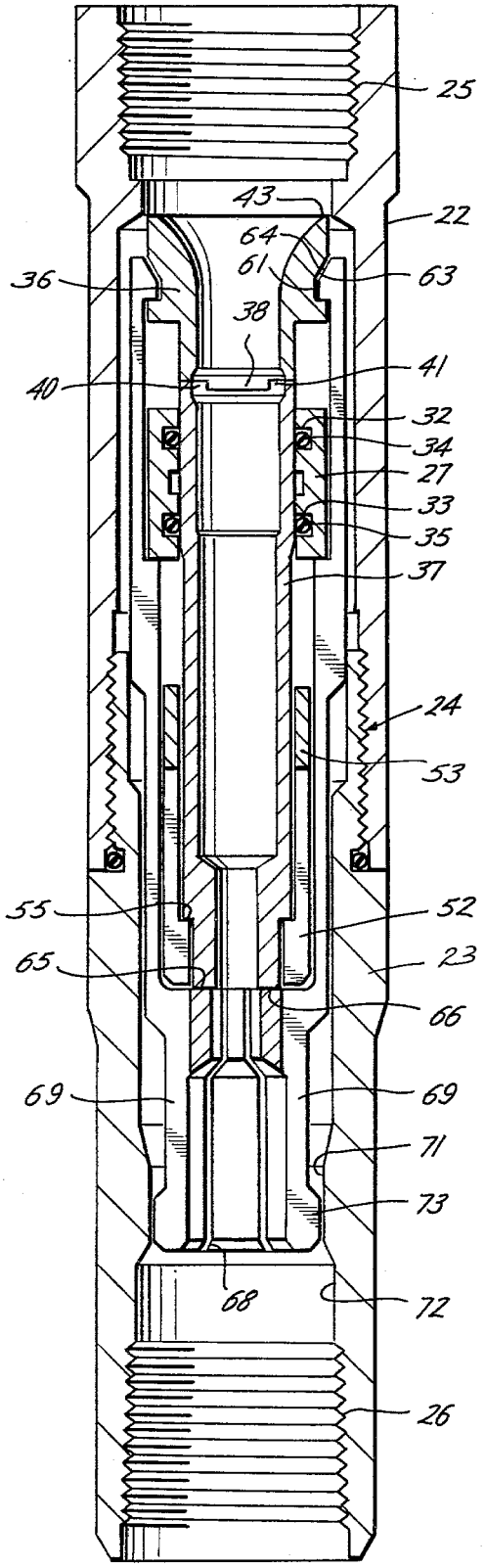
FIG. 3 is another cross-sectional view through the valve of this invention taken along the lines 3—3 of FIG. 4 and perpendicular to the section of FIG. 2.

Means are provided for maintaining the liner and funnel in coaxial relationship. This may be any desired means. As shown in FIGS. 2 and 3, the juncture between the liner 37 and funnel 36 is not in a single plane but is stepped so that the liner and funnel each has two symetrically positioned teeth which interfit with each other. Thus, the funnel carries teeth 38 and 39 and the liner has cooperating teeth, one of which is shown at 41. The side walls of these step-like teeth are cut on radii of the valve member. Preferably they are cut to close tolerance so that when the funnel and liner are interfitted the opposing teeth of the funnel and liner will interengage and maintain the funnel and liner in coaxial alignment. As the funnel moves into the seal fitting 27, this fitting 27 will also tend to hold the funnel and liner in coaxial alignment.

Figure 9:
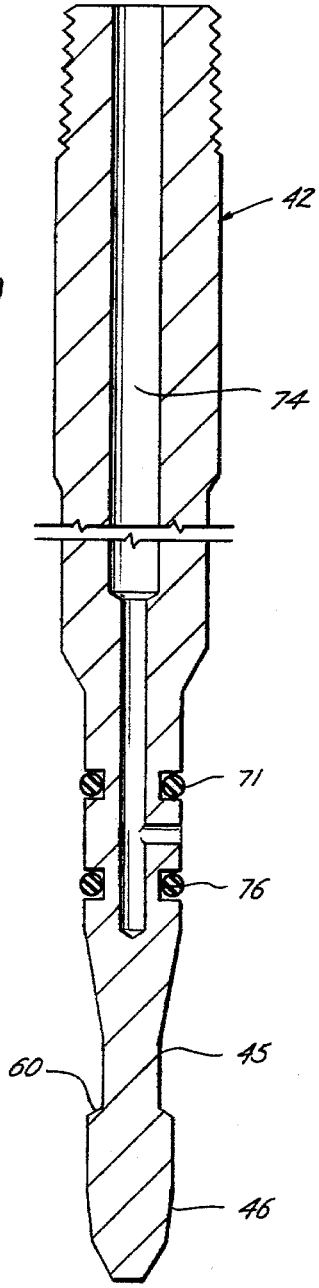
FIG. 9 is a view partly in elevation and partly in cross-section through one form of prong to be used with the illustrated form of valve of this invention.

A prong such as the prong indicated generally at 42 in FIG. 9 may be utilized to move the valve member between open and closed positions. The prong will customarily be run in the well, as upon a wireline, and will seat on the valve member. Seating may occur at the upper lip 43 of the funnel or at the shoulder 44 adjacent the bottom of the liner 37. In either event, the reduced diameter or groove section 45 just above the head 46 of the prong 42 will be positioned opposite a pair of opposing cutouts 47 in the liner 37.

In order to detent the valve member in closed position, and to provide for latching of the valve member to a prong such as prong 42, the valve member carries a suitable collet 48. This collet is shown in detail in FIGS. 7 and 8. The collet has inwardly and outwardly facing dogs 49 and 50 carried on the collet arms 51. These arms are in turn carried by collet arms 52. Thus, each collet arm 51 extends between two collet arms 52 on either side thereof and the collet arms 52 are interconnected at 53. This provides for resiliency in both the arms 51 and 52.

Referring to FIG. 2, the liner 37 has a circumferential radially extending flange 54 which is engaged by the shoulder 55 internally of the collet.

The seal carrier 27 is provided with a groove 56 and immediately therebelow a land 57. This groove and land cooperate with the dog 50 on the collet and when the valve is in the closed position as shown, the dog 50 lies within the groove 56. When the valve is shifted downwardly to open the valve, the dog 50 engages the land 57 causing the collet arms to move inwardly and move the dog portion 49 into a position to engage shoulder 60 between the groove 45 and head 46 on the prong 42 (FIG. 9). Thus, as the prong is moved downwardly it shifts the sleeve valve from closed to open position against the resistance of the detent action of the collet. When the valve moves to open position the collet dogs 49 engage the prong and hold the prong and valve member interengaged until the valve member is again shifted upwardly to the closed position, at which time the dogs release the prong and permit its withdrawal.

Arm means are provided for holding the funnel and liner together and for holding the funnel and liner very close to each other as their juncture passes over O-ring 34 and permitting this juncture point to open up under pressure of the fluid in the system when the valve is open.

The arm means indicated generally at 58 is best seen in FIGS. 5 and 6, taken in conjunction with FIGS. 2 and 3. Arm 58 is provided with four finger-like upper extremities 59. Referring to FIGS. 7 and 8, it will be noted that the collet arms 51 have a small circumferential dimension leaving a wide space on opposite sides of these fingers. The two pairs of fingers 59 extend in these spaces. The fingers 59 have circumferentially extending, inwardly projecting flanges 61 which mate with groove 62 in the funnel (FIGS. 2 and 3). The square shouldered relationship between the upwardly facing shoulder on the funnel and the downwardly facing shoulder on the flange 61 of the arm permits the arm to place a downward pull on the funnel 36. The chamfered shoulder 63 on the funnel and the mirror image shoulder 64 on the arm 58 permit all of the assembly except the funnel to be installed in the body from the lower end, and the funnel to be installed in the body from the upper end.

At an intermediate portion of the arm means 58 a shoulder 65 is provided which confronts the lower end 66 of the tubular liner. The juncture of the two shoulders 65 and 66 is spaced radially inwardly a substantial distance from the fingers 59 and this juncture acts as a fulcrum or pivot about which the arms 58 may rotate to change the relationship of the funnel and liner to each other. The arms will bend in the area 67 to change this relationship.

In order to provide for pivoting of the arms about the end of the liner, the arm means 58 is slotted at its lower end at 68 so that the several lower fingers 69 may move radially.

To provide for the above described radial motion, the lower body section 23 has a land 71 and an adjacent groove 72. The lower fingers 69 of the arm means 58 are provided with dogs 73 which engage the land 71 during the time that the juncture between the funnel and the liner are moving over the seal 34. While the dogs 73 are in engagement with the land 71 they are held against radial outer movement and the dimensional relationship of the parts are such that by exerting force on the fulcrum parts 65 and 66 the arm means holds the funnel and liner very close to each other. When the valve member is shifted downwardly the funnel and liner are held close together until their juncture passes over the O-ring 34. After the O-ring 34 has been cleared, the dogs 73 move into the groove 72 and are no longer functional to prevent spreading of the lower fingers 69 to permit slight upward movement of the upper fingers 59 relative to the tubular liner 37 and thus open up the gap between the tubular liner 37 and the funnel 36. Preferably, the gap opens up to a spacing of several thousandths of an inch to permit the desired flow through port 28.

The device is assembled by first welding the seal carrier 27 in the upper body 22. Space between the carrier and body permit fluid communication from above O-ring 34 to below O-ring 35 to prevent a fluid lock when running probe 42. The liner, collet and arm means are then assembled together and introduced into the bottom of housing 22. The funnel is then introduced from the upper end of body 22 and moved down over the flange 61 of the arm means until the flange engages in the groove 62 in the funnel. The two body parts may then be made up together and a plug introduced into the lower threaded section 26 of the body or a tubular extension with a suitable plug at its lower end may be made up in the threaded section 26. The body is then attached to a locking mandrel.

The operation of the transducer fitting will be explained assuming that it is to be run after tubing has been installed. In this event the well would first have the packer 14 with the foot valve 15 and landing nipple 16 run into the well and secured in place by setting of the packer in any desired conventional manner.

If testing is to be delayed until some future time after the well is completed, it may be desirable to run a locking mandrel with a plug therein to plug the well at the packer. If so, when testing is to be commenced this locking mandrel and plug would be removed.

In any event, when it is desired to commence testing the tubing string 18 is run into the well and the tailpipe or lower end of the tubing string is sealingly engaged with the packer 14.

The dump valve 21 is opened by the weight of the tubing thereabove providing a clear unobstructed tubing. Of course, the packer and landing nipple have a bore therethrough to permit running of the desired tools.

The locking mandrel has the transducer fitting 17 made up on the lower end thereof and the transducer fitting and locking mandrel are run in as a unit, as by wireline. If desired, the valve member may be securely held in either open or closed position during either running or pulling by providing a suitable prong on the bottom of the locking mandrel running tool. For instance, if it is desired to run or pull the transducer fitting with the valve locked in the open position, a prong such as that shown in FIG. 9 but without the flowway 74 and O-rings 75 and 76 could be used. As the spacing of the tools would position the prong holding the valve member in the down or open position with the collet dogs 49 extended inwardly, the valve would be held in open position until the locking mandrel was landed and the running tool withdrawn, which would simultaneously withdraw the running prong and move the valve member to the closed position shown in FIGS. 2 and 3. On the other hand, if it be desired to run the valve in closed position and insure that it remain closed, a running prong would be utilized without the groove 45 so that this area of the prong would be of a diameter preventing inward movement of the collet dogs 49 and the space-out of the prong and the running tool would be such that the prong would not move the valve member downwardly but would permit it to remain in the up position shown in FIG. 2.

In any event, after the locking mandrel is latched in place the transducer fitting may be utilized to collect samples or to convey fluid to a pressure recording or sending device to record pressure in the well. The prong 42 may have connected to its upper end either a recording device or a transducer attached to the surface through an electric line. The prong 42 will be run in the well and moved downwardly to force the valve member to open position with the O-rings 75 and 76 of the prong straddling the juncture between the funnel 36 and the liner 37. The O-rings 75 and 76 are of equal diameter so that forces due to pressure from port 28 are balanced and only friction need be overcome to run or pull the prong. Normally the weight of the prong is all that is necessary to seat the prong. Thus, when the valve member moves downwardly to open position flow may occur through port 28, the juncture between the funnel and liner, and into the flowway 74 in the prong. The pressure may be conducted to a suitable transducer and the pressure continuously read at the surface or recorded in a suitable recording device connected to the prong. While the prong is in place and the valve member is in the down position, the collet dogs 49 will latch the valve member to the prong. As the entire assembly, including the arms 58, is in the down position, the dogs 73 overlie grooves 72 and well pressure will be exerted in opposite directions on the funnel 36 and the liner 37. This well pressure will urge the funnel and liner away from each other. As the split arm 58 is in the down position and the dogs 73 are inactive, this force exerted through the fulcrum points 65 and 66 will cause the arm means to bend in the area 67 for permitting the funnel and liner to move apart a slight amount and open up the flowway through the valve member into its interior to permit free access of fluid into the flowway 74 in the prong.

After testing has been completed, the prong 42 will be withdrawn. As the prong moves upwardly, the collet dogs 49 engaging the prong head 46 will move the valve member to the up or closed position prior to the collet dogs 49 releasing the head 46 on the prong and permitting the prong to be withdrawn from the well.

If desired, the transducer fitting and its associated locking mandrel may now be removed from the well. If it is desired to remove from the well a sample of fluid when the locking mandrel and transducer fitting are removed, the operating prong would first be run to open the valve and permit flow from the well into the transducer fitting and the locking mandrel. The valve would then be closed and a suitable prong run on the locking mandrel retrieving tool to fill the gap between the collet dogs 49 and lock the valve in the closed position. Then as the locking mandrel and transducer are brought to the surface, they will contain a sample of fluid at the bottom of the well at the time that the transducer was pulled. If it is desired that the sample be uncontaminated, a suitable seal can be provided between the prong and the bore through the locking mandrel.

Of course, a sample can be brought to the surface with the pressure reading prong by providing a suitable chamber in conjunction with the passageway 74 and a back check valve to prevent loss of well fluid after the prong is withdrawn from the transducer fitting.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A valve comprising
a tubular body,
a side port in said body,
a pair of circumferential seals in the wall of said body straddling said port,
a valve member controlling flow through said port including a tubular funnel and a tubular liner arranged in end to end abutment and movable axially to pass said abutment across one of said seals,
means maintaining said funnel and liner in coaxial alignment,
means holding said funnel and liner with no more than slight spacing therebetween while the juncture between said funnel and liner passes over one of said seals as the valve moves between open and closed position and permitting said funnel and liner to move apart in response to the valve member moving to open position.

2. The valve of claim 1 wherein the valve member includes a collet having dogs in a groove in the body when the valve member is in closed position, said dogs positioned over a land and extended when the valve member is in open position.

3. The valve of claim 2 in combination with an actuating prong having a groove receiving said extended dogs.

4. The valve of claim 3 wherein the prong has a flow passageway therein communicating with the juncture between said liner and funnel when the dogs are in the groove on the prong, and
seals are provided between the prong and liner and between the prong and funnel.

5. A valve comprising
a tubular body,
a side port in said body,
a pair of circumferential seals in the wall of said body straddling said port,
a valve member controlling flow through said port including a tubular funnel and a tubular liner arranged in end to end abutment and movable axially to pass said abutment across one of said seals,
means maintaining said funnel and liner in coaxial alignment,
a land and groove in said body, and
arm means having one end attached to said funnel and an intermediate section pivoting about the end of the liner remote from said funnel and the other end alternately engaging said land to hold the liner and funnel close to each other and moving into said groove to permit pivoting of said arm means to open up the space between said liner and funnel.

6. The valve of claim 5 wherein the valve member includes a collet having dogs in a groove in the body when the valve member is in closed position, said dogs positioned over a land and extended when the valve member is in open position.

7. The valve of claim 6 in combination with an actuating prong having a groove receiving said extended dogs.

8. The valve of claim 7 wherein the prong has a flow passageway therein communicating with the juncture between said liner and funnel when the dogs are in the groove on the prong, and
seals are provided between the prong and liner and between the prong and funnel.

9. A valve comprising
a tubular body,
a side port in said body,
a pair of circumferential seals in the wall of said body straddling said port,
a valve member controlling flow through said port including a tubular funnel and a tubular liner arranged in end to end abutment,
means containing said funnel and liner in coaxial alignment,
a first land and groove in said body, collet means carried by the valve member and having dogs retracted when in said first groove and extended inwardly when over said land to engage an actuating tool, a second land and groove in said body, arm means having one end attached to said funnel, the other end having dogs engaging said second land when the valve member is in open position and overlying said second groove when the valve member is in open position, said arm means having an intermediate section engaging the end of said liner and pivoting about the end of said liner to decrease the gap between said liner and funnel when in the closed position and to permit the gap to open up when the valve member is in open position.

10. The valve of claim 9 wherein the valve member includes a collet having dogs in a groove in the body when the valve member is in closed position, said dogs positioned over a land and extended when the valve member is in open position.

11. The valve of claim 10 in combination with an actuating prong having a groove receiving said extended dogs.

12. The valve of claim 11 wherein the prong has a flow passageway therein communicating with the juncture between said liner and funnel when the dogs are in the groove on the prong, and seals are provided between the prong and liner and between the prong and funnel.

13. The valve of claim 9 wherein said circumferential seals are of equal diameter to balance forces exerted by pressure on said valve member from said side port.

14. The valve of claim 13 in combination with an actuating prong having a groove receiving said extended dogs and a flow passageway therein communicating with the juncture between said liner and funnel when the dogs are in the groove on the prong, and equal diameter seals are provided between the prong and liner and between the prong and funnel.

15. The valve of claim 10 wherein fluid communication is provided in the body connecting a point on one side of said circumferential seals with a point on the other side of said circumferential seals to prevent a fluid lock when said actuating prong is run into the valve member.

* * * * *